US010766677B2

(12) United States Patent
Keep

(10) Patent No.: US 10,766,677 B2
(45) Date of Patent: Sep. 8, 2020

(54) TAMPER-EVIDENT ATTACHMENT FOR CABLE TIE

(71) Applicant: Election Systems & Software, LLC, Omaha, NE (US)

(72) Inventor: Patrick Keep, Omaha, NE (US)

(73) Assignee: Election Systems & Software, LLC, Omaha, NE (US)

( * ) Notice: Subject to any disclaimer, the term of this patent is extended or adjusted under 35 U.S.C. 154(b) by 92 days.

(21) Appl. No.: 16/110,477

(22) Filed: Aug. 23, 2018

(65) Prior Publication Data

US 2019/0062015 A1 Feb. 28, 2019

Related U.S. Application Data

(60) Provisional application No. 62/549,257, filed on Aug. 23, 2017.

(51) Int. Cl.
*B65D 63/10* (2006.01)

(52) U.S. Cl.
CPC ..... *B65D 63/1063* (2013.01); *B65D 63/1027* (2013.01); *B65D 2401/15* (2020.05); *B65D 2563/108* (2013.01)

(58) Field of Classification Search
CPC ..... Y10T 24/1498; B65D 63/1027; B65D 63/1063; B65D 2563/108; B65D 2101/0023
See application file for complete search history.

(56) References Cited

U.S. PATENT DOCUMENTS 4,902,055 A * 2/1990 Scott ..... B65D 77/185 292/319
6,347,435 B1 * 2/2002 Davignon ..... B65D 63/1063 24/16 PB

OTHER PUBLICATIONS

My ES&S Website, Security Seals, https://shop.essvote.com/ProductListing.aspx?CatId=6199af8a-7d9c-4976-9ef2-44d6a940e3b8&Clicked=HomeCategory, retrieved Aug. 5, 2019, pp. 3.

* cited by examiner

*Primary Examiner* — Robert Sandy
(74) *Attorney, Agent, or Firm* — Stinson LLP

(57) ABSTRACT

A tamper-evident attachment for a cable tie includes a ratchet head cover configured to couple to a ratchet head of the cable tie such that the ratchet head cover covers at least a portion of a head opening of the ratchet head to inhibit access a pawl in the ratchet head. The ratchet head cover defines at least one slot-shaped opening configured to align with the head opening of the ratchet head when the ratchet head cover is coupled to the ratchet head. The at least one slot-shaped opening is sized and shaped to receive a strap of the cable tie therethrough.

18 Claims, 14 Drawing Sheets

TAMPER-EVIDENT ATTACHMENT FOR CABLE TIE

CROSS-REFERENCE TO RELATED APPLICATION

The present application claims the benefit of U.S. Provisional Application No. 62/549,257, filed Aug. 23, 2017, the entirety of which is hereby incorporated by reference.

FIELD OF THE DISCLOSURE

The present disclosure generally relates to a tamper-evident attachment for a cable tie, and a cable tie including the tamper-evident attachment to form a tamper-evident security seal.

BACKGROUND OF THE DISCLOSURE

Cable ties are commonly used to secure two or more components together, for example, by extending around and/or through the components. In one example, cable ties may be used as part of security seal to securely close (e.g., seal) a lid of a ballot box containing ballots. Generally, security seals are designed to indicate tampering if the ballot box is opened.

SUMMARY OF THE DISCLOSURE

In one aspect, a tamper-evident attachment for a cable tie includes a cover sized and shaped to fit on a ratchet head of a cable tie. The cover is configured to inhibit access to a head opening and/or a deflectable pawl of the cable tie when the cable tie is used as a security seal.

In another aspect, a security seal includes a cable tie and a tamper-evident attachment coupled to a ratchet head. The attachment may be a separate component that is slidably or otherwise received on the ratchet head. Alternatively, the attachment and the cable tie may be integrally formed as a one-piece component, such as by molding or other techniques.

In another aspect, a tamper-evident attachment for a cable tie of the type including a ratchet head defining a head opening, a deflectable pawl in the head opening, and a flexible strap extending from the ratchet head, includes a ratchet head cover configured to couple to the ratchet head of the cable tie such that the ratchet head cover covers at least a portion of the head opening to inhibit access to the pawl. The ratchet head cover defines at least one slot-shaped opening positioned to align with the head opening of the ratchet head when the ratchet head cover is coupled to the ratchet head. The at least one slot-shaped opening being sized and shaped to receive the strap of the cable tie therethrough.

In another aspect, a tamper-evident security seal includes a cable tie and a tamper-evident attachment. The cable tie includes a ratchet head defining a head opening with a deflectable pawl in the head opening and a flexible strap extending from the ratchet head. The tamper-evident attachment is configured to couple to the ratchet head of the cable tie such that the tamper-evident attachment covers at least a portion of the head opening to inhibit access to the pawl. The tamper-evident attachment defines at least one slot-shaped opening positioned to align with the head opening of the ratchet head when the tamper-evident attachment is coupled to the ratchet head. The at least one slot-shaped opening being sized and shaped to receive the strap of the cable tie therethrough.

In another aspect, a tamper-evident security seal includes a cable tie and a tamper-evident attachment. The cable tie includes a ratchet head defining a head opening with a deflectable pawl in the head opening and a flexible strap extending from the ratchet head. The tamper-evident attachment is coupled to the ratchet head of the cable tie and covers at least a portion of the head opening to inhibit access to the pawl. The tamper-evident attachment defines at least one slot-shaped opening aligned with the head opening of the ratchet head that is sized and shaped to receive the strap of the cable tie therethrough.

BRIEF DESCRIPTION OF THE DRAWINGS

Corresponding reference characters indicate corresponding parts throughout the drawings.

DETAILED DESCRIPTION OF THE DISCLOSURE

Figure 5:
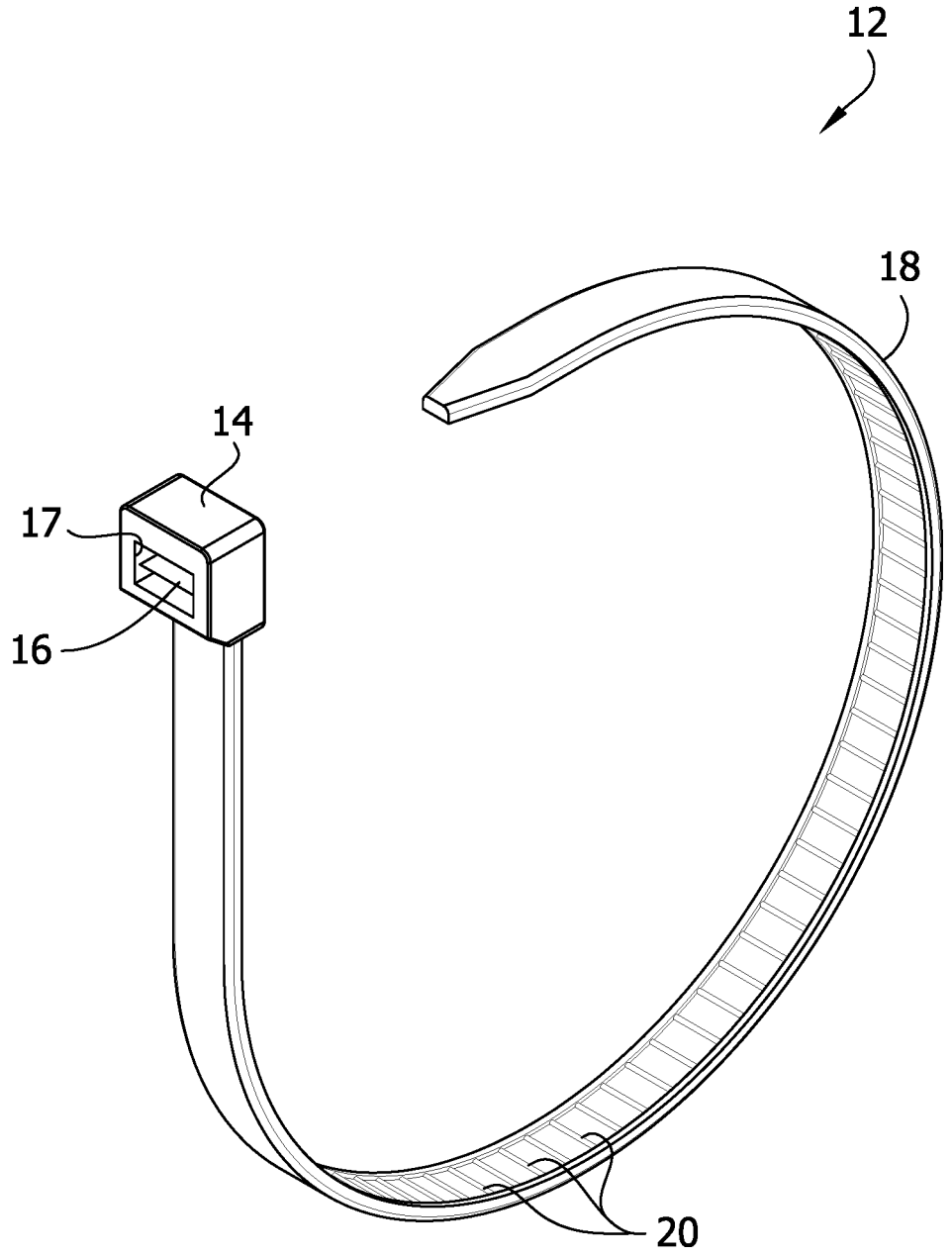
FIG. 5 is a perspective of one embodiment of a cable tie.

Referring to FIGS. 1-4, an illustrated embodiment of a tamper-evident attachment for a cable tie is generally indicated at reference numeral 10. Referring to FIG. 5, a suitable conventional cable tie for use with the tamper-evident attachment 10 is generally indicated at reference numeral 12. The conventional cable tie 12 comprises a ratchet head 14 having a resiliently deflectable pawl 16 received in a head opening 17 defined by the ratchet head; and a strap 18 extending from the ratchet head and having a plurality of teeth 20 spaced apart along its length. In general, and as is generally known, the strap 18 is flexible to allow its free end to be inserted into the head opening 17 of the ratchet head 14, whereby the teeth 20 on the strap 18 resilient deflect the pawl 16 as the strap moves through the head. The teeth 20 engage the pawl 16 when a withdrawal force is applied to the strap 18 to inhibit the strap from backing out and withdrawing from the ratchet head. One method of removing the cable tie 12 after the strap 18 is inserted into the ratchet head 14 is to resiliently deflect the pawl 16 (manually or with a tool) such that the pawl disengages the teeth 20 on the strap and the strap can be withdrawn from the ratchet head. The cable tie 12 may be made from plastic or other material. The cable tie may also be referred to as a hose tie, a steggel tie, a zap strap or a zip tie.

Referring back to FIGS. 1-4, the tamper-evident attachment 10 is generally configured as a cover for the ratchet head 14. As illustrated, the attachment 10 is configured as a component separate from the cable tie 12 and is configured to couple to the cable tie. The attachment 10 may be formed from plastic, such as Nylon (e.g., Nylon 6/10), or other material. In other embodiments, the attachment 10 and the cable tie 12 may be integrally formed as a one-piece component or otherwise fastened to one another, such as with adhesive, with a friction (e.g., snug) fit, or with other types of mechanical connections, before being secured to the cable tie, as described in more detail below. It is also understood that in other embodiments the tamper-evident attachment 10 may be designed and configured for use with other types of cable ties, having designs, configurations, shapes, and/or sizes different than the illustrated cable tie 10.

Figure 1:
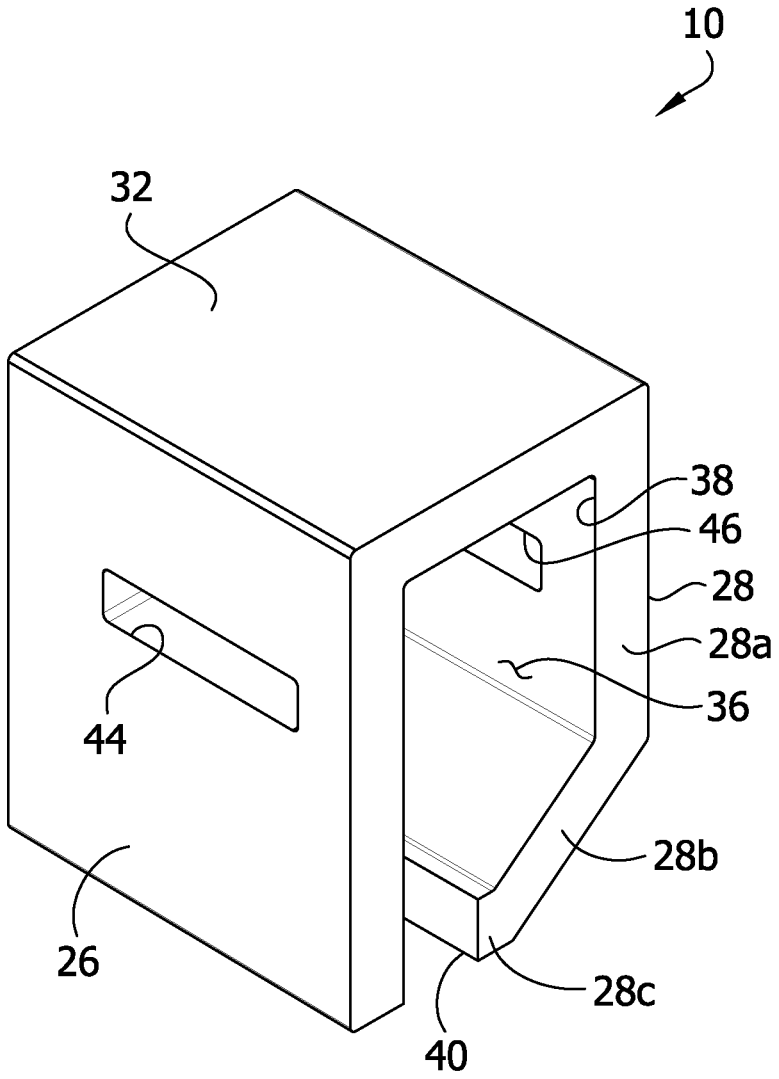
FIG. 1 is a perspective of one embodiment of a tamper-evident attachment for a cable tie.
Figure 2:
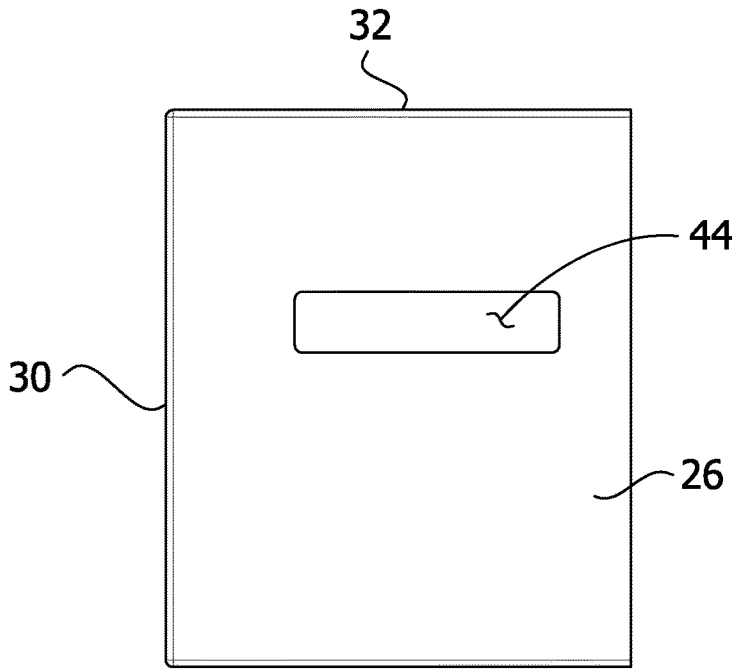
FIG. 2 is a left side elevation of the tamper-evident attachment of FIG. 1.
Figure 3:
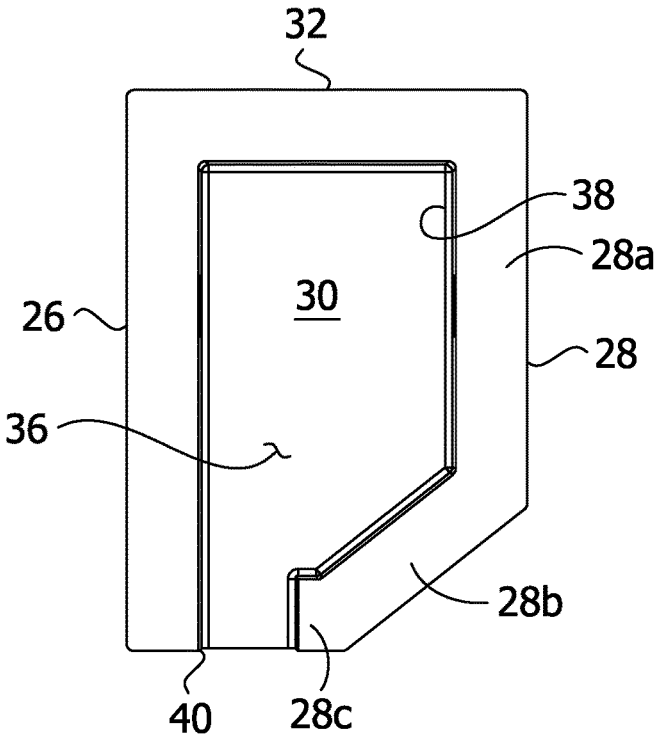
FIG. 3 is a front elevation of the tamper-evident attachment of FIG. 1.
Figure 4:
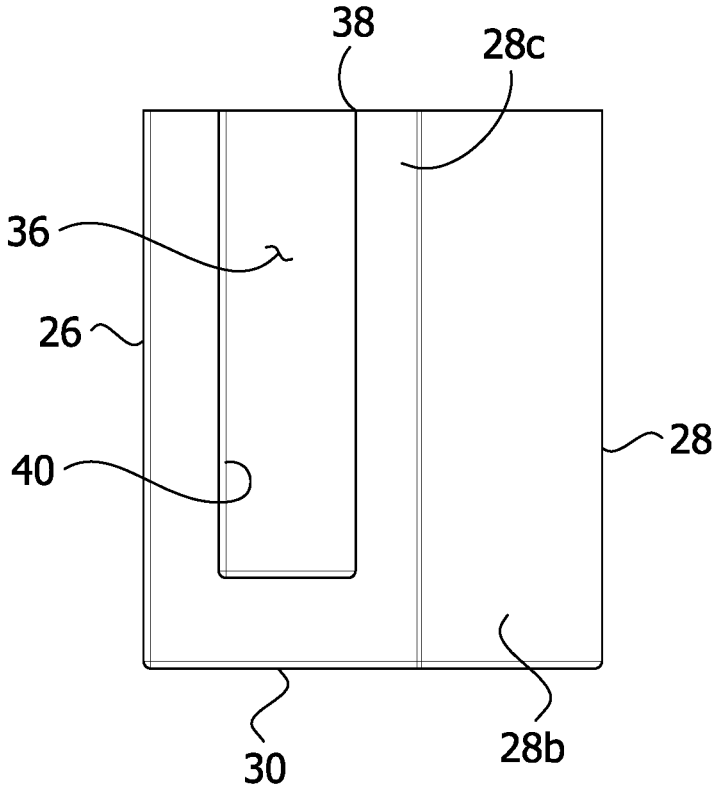
FIG. 4 is a bottom plan of the tamper-evident attachment of FIG. 1.

The tamper-evident attachment 10 includes a left wall 26, a right wall 28 generally opposing the left wall, a rear wall 30 extending between and connecting the left and right walls, and an upper wall 32 interconnecting upper ends of the left, right, and rear walls. (As used herein, the terms used to describe relative locations and positions of the components and structures of the tamper-evident attachment 10, including but not limited to "left," "right," "upper," "lower," "rear," and "front," are in reference to the orientation of the tamper-evident attachment as shown in FIG. 1 for purposes of convenience and are not to be interpreted in a limited sense.) Each of the left, rear, and upper walls 26, 30, and 32, respectively, are generally planar although they may be of other shapes and configurations. The right wall 28 includes an upper planar portion 28*a* that is generally planar to the left wall 26, a transition portion 28*b* extending downward from a lower end of the upper planar portion and toward the left wall (e.g., the transition portion slopes toward the left wall), and a lower flange portion 28*c* projecting outward from a lower end of the transition portion toward the left wall.

Together, interior surfaces of the walls 26, 28, 30, and 32 define a cavity 36 sized and shaped to receive the ratchet head 14 of the cable tie 12 therein. The shape of the cavity 36 generally corresponds to the shape of the ratchet head 14. A front of the attachment 10 (e.g., as defined by front surfaces of the left, right and upper walls 26, 28, and 32, respectively) defines a front opening 38 in communication with (e.g., leading to) the cavity 36. A bottom of the attachment 10 (e.g., as defined by lower surfaces of the left, right and rear walls 26, 28, and 30, respectively) defines a bottom opening 40 in communication with (e.g., leading to) the cavity 36. The bottom opening 40 is also in communication with (e.g., is a continuation of) the front opening 38. The left wall 26 defines a first slot-shaped opening 44 extending therethrough and into the cavity 36. The right wall 28 (e.g., the upper planar portion 28*a*) defines a second slot-shaped opening 46 extending therethrough and into the cavity 36. The first and second slot-shaped openings 44, 46, respectively, are generally aligned and may have generally the same dimensions. In one embodiment, one or both of the slot-shaped openings 44, 46 may have a width of about 0.37 in (9.4 mm) and a height of about 0.085 in (2.2 mm), which correspond to a strap 18 of a cable tie 12 having a width of about 0.36 in (9.1 mm) and a height (e.g., thickness) of about 0.078 in (2 mm). The slot-shaped openings 44, 46 may have other dimensions to correspond to a strap 18 of other sizes. The width of at least one of the slot-shaped openings 44, 46 is slightly greater than the width of the strap 18 of the cable tie 12, and the height of the at least one of the slot-shaped openings 44, 46 is slightly greater than the thickness of the strap so that the at least one slot-shaped opening snugly receives the strap therethrough (e.g., the at least one slot-shaped opening is in a close fitting relationship with the strap). The close fit between the slot-shaped openings 44, 46 and the strap 18 of the cable tie 12 ensures the left and right walls 26, 28 sufficiently cover the head opening 17 of the cable tie 12 to prevent access to the pawl 16.

Figure 6:
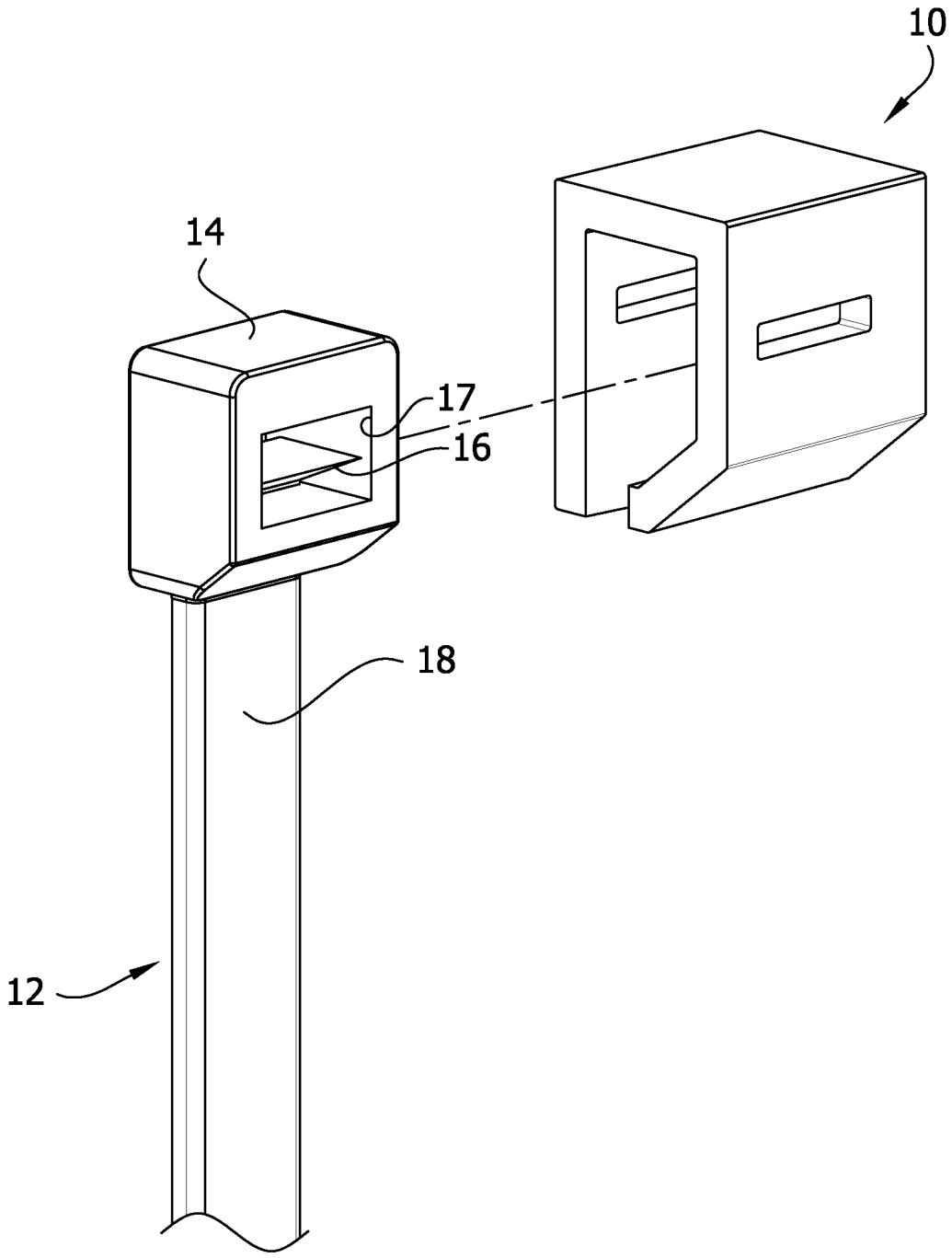
FIG. 6 is a perspective illustrating the tamper-evident attachment of FIG. 1 being coupled to the cable tie.
Figure 7:
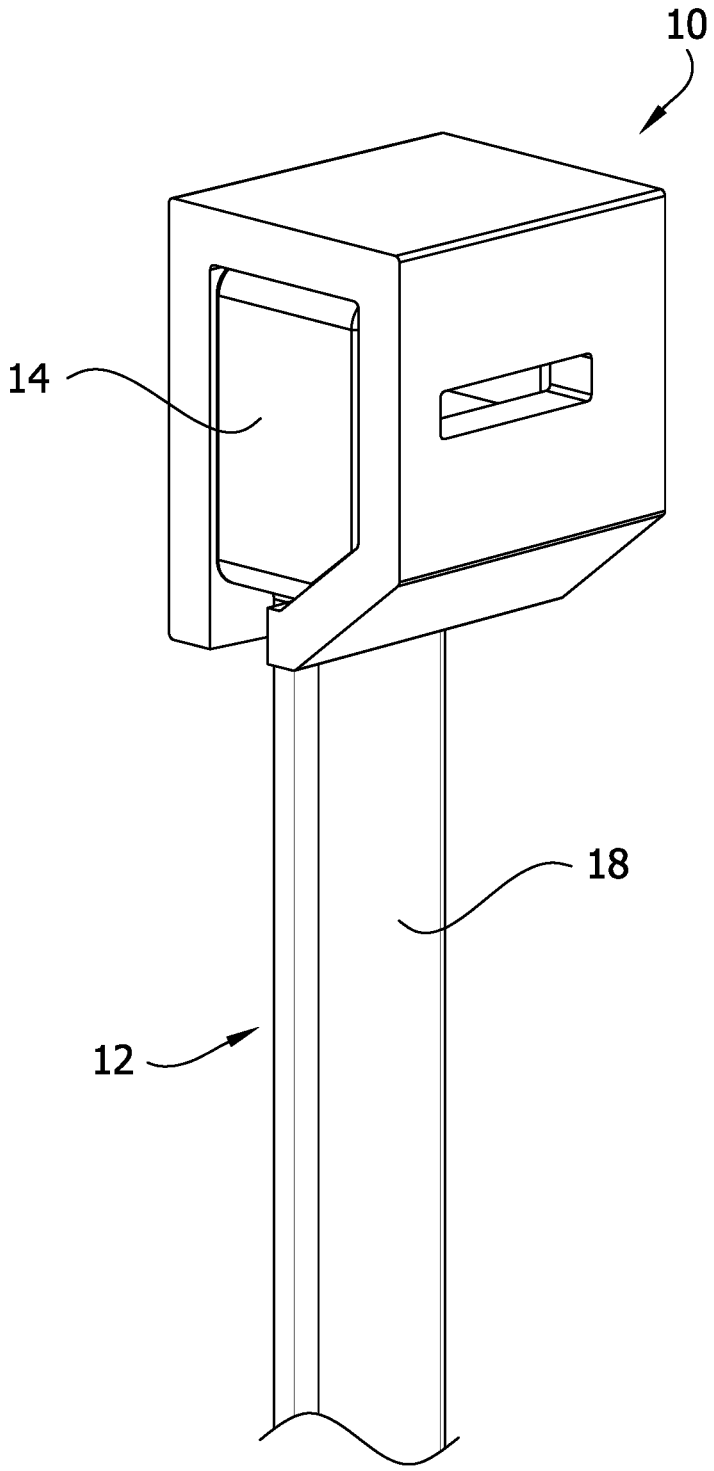
FIG. 7 is a perspective of the tamper-evident attachment of FIG. 1 coupled to the cable tie to form a tamper-evident security seal.
Figure 8:
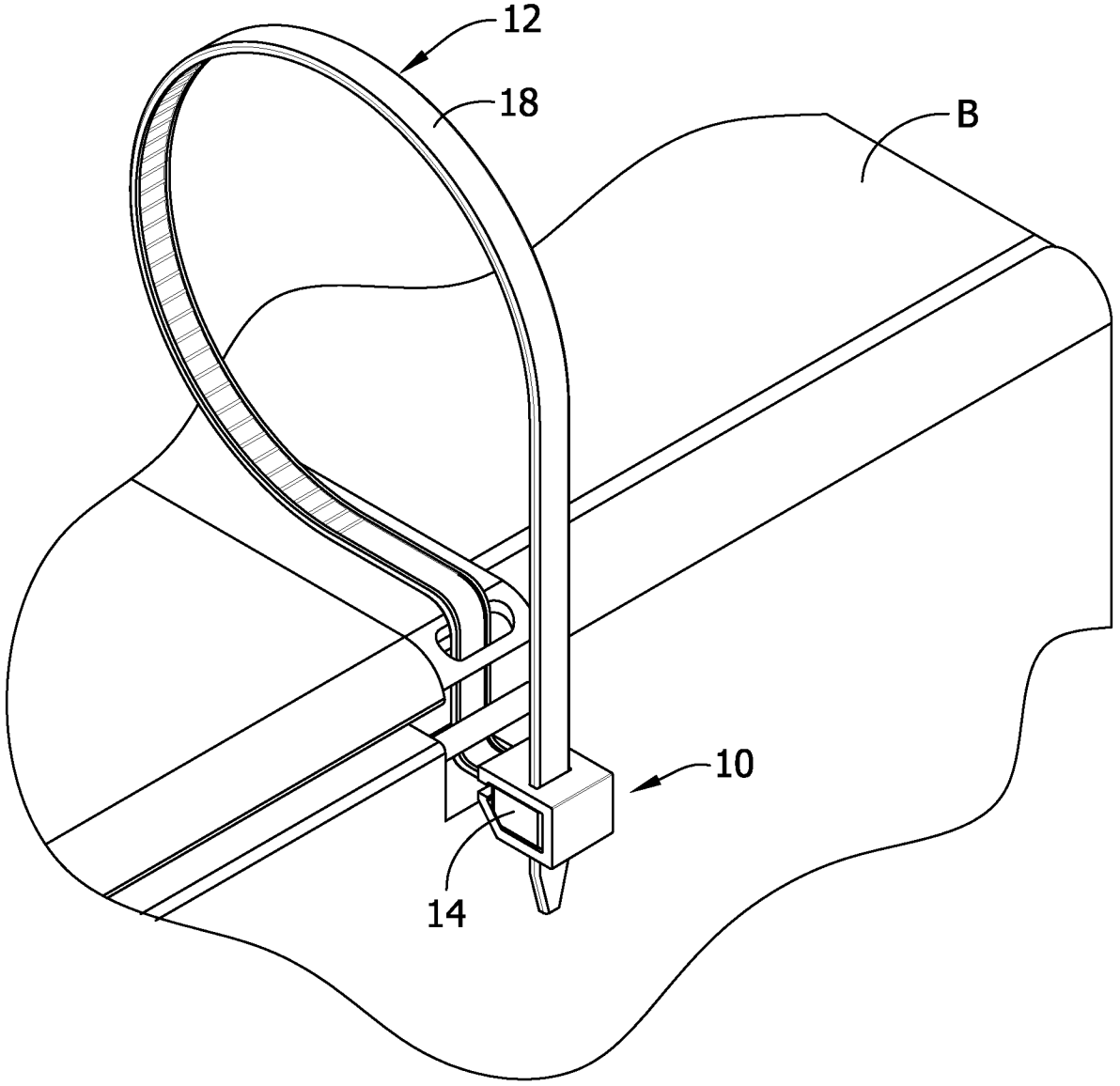
FIG. 8 is a perspective of the formed tamper-evident security seal of FIG. 7 locking a lid of a ballot box to inhibit opening the ballot box.
Figure 9:
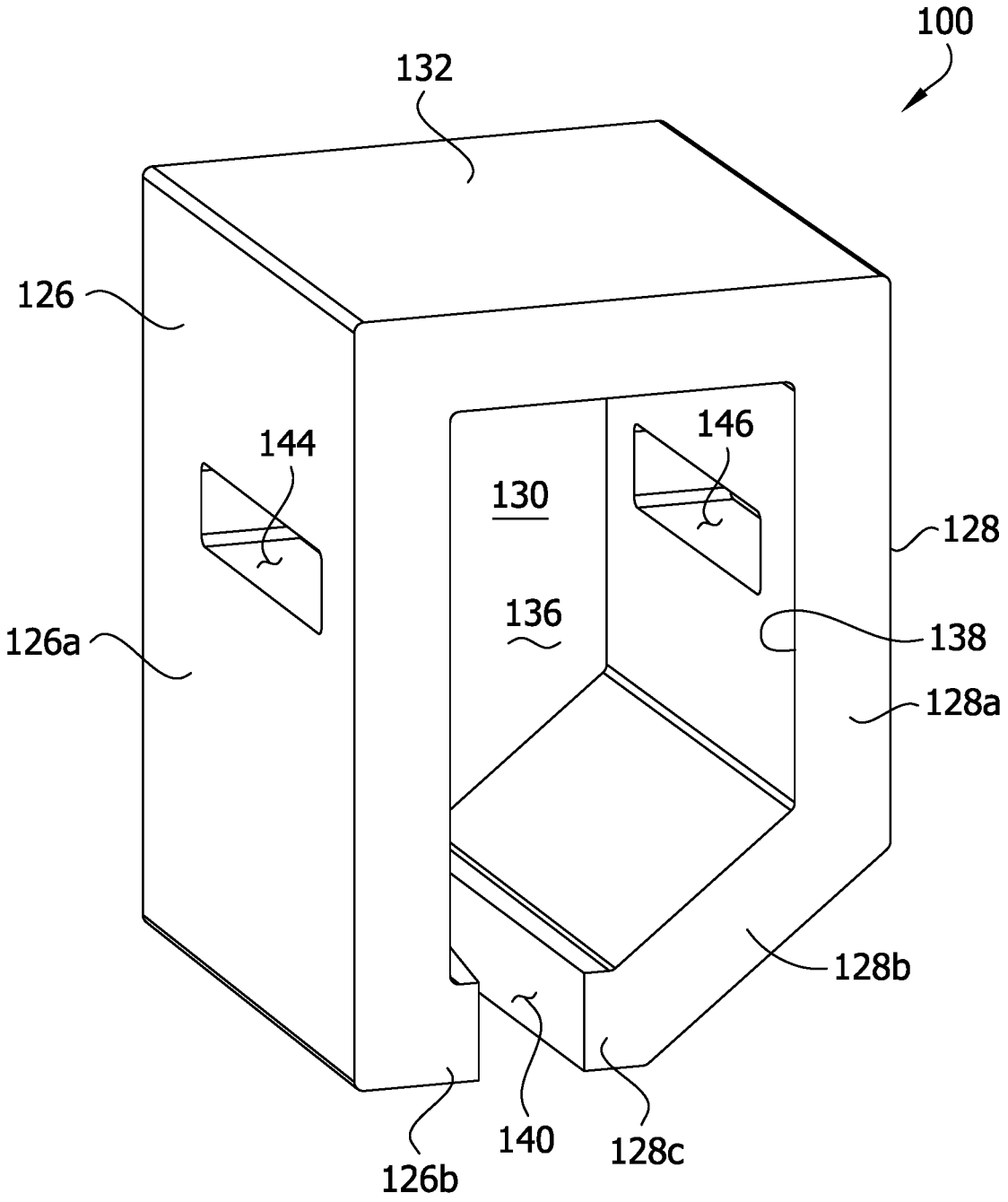
FIG. 9 is a perspective of another embodiment of a tamper-evident attachment for a cable tie.
Figure 10:
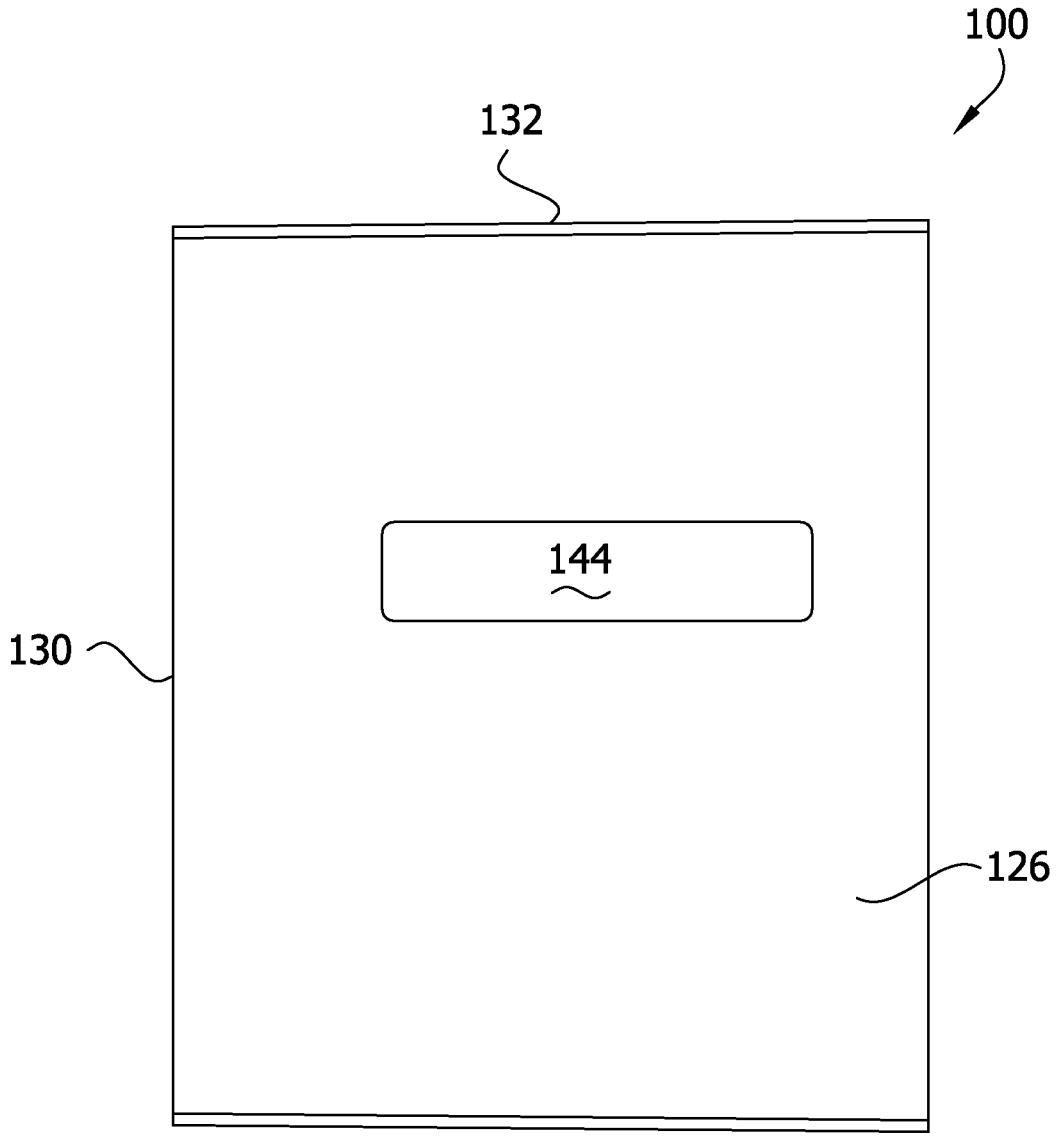
FIG. 10 is a left side elevation of the tamper-evident attachment of FIG. 9.
Figure 11:
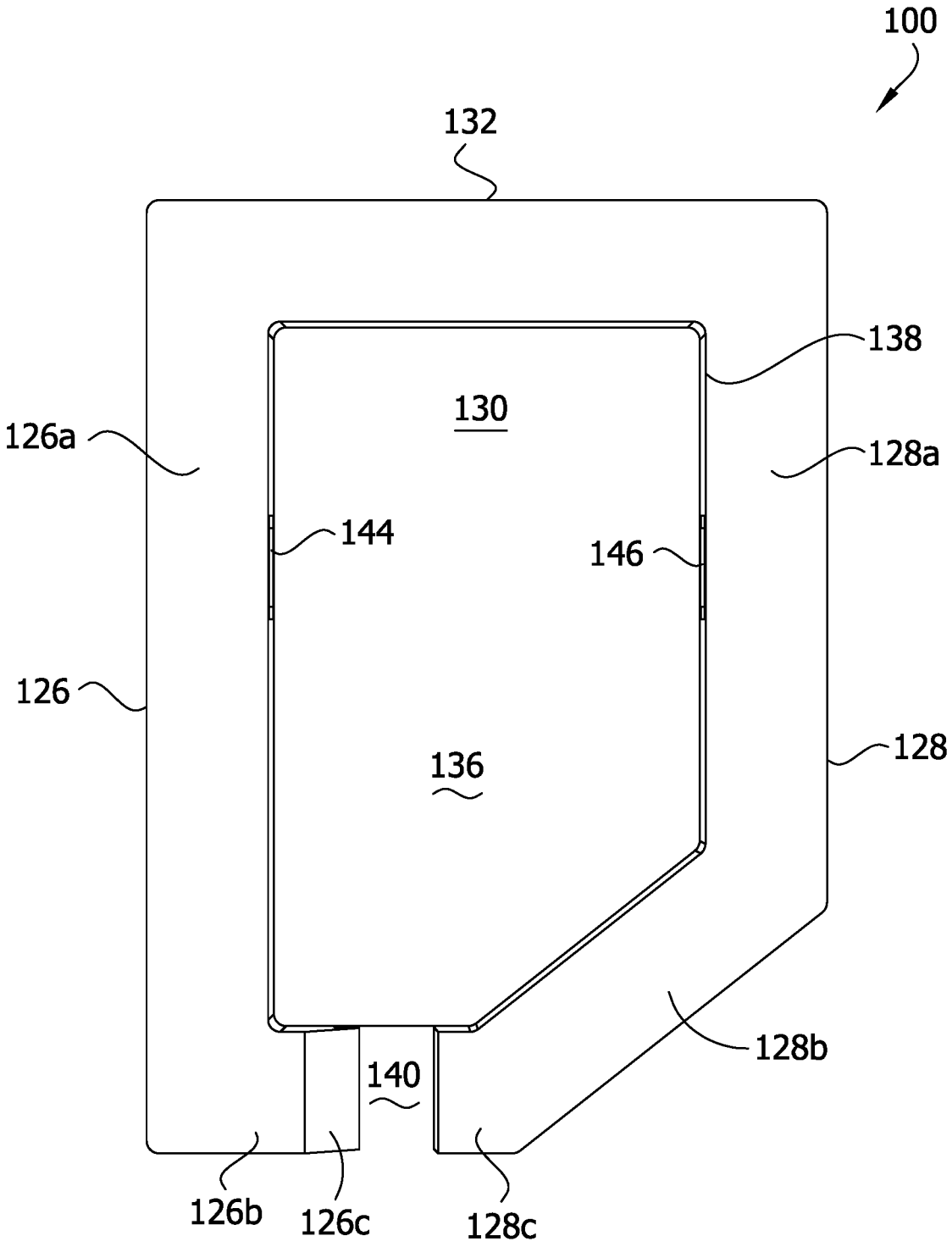
FIG. 11 is a front elevation of the tamper-evident attachment of FIG. 9.
Figure 12:
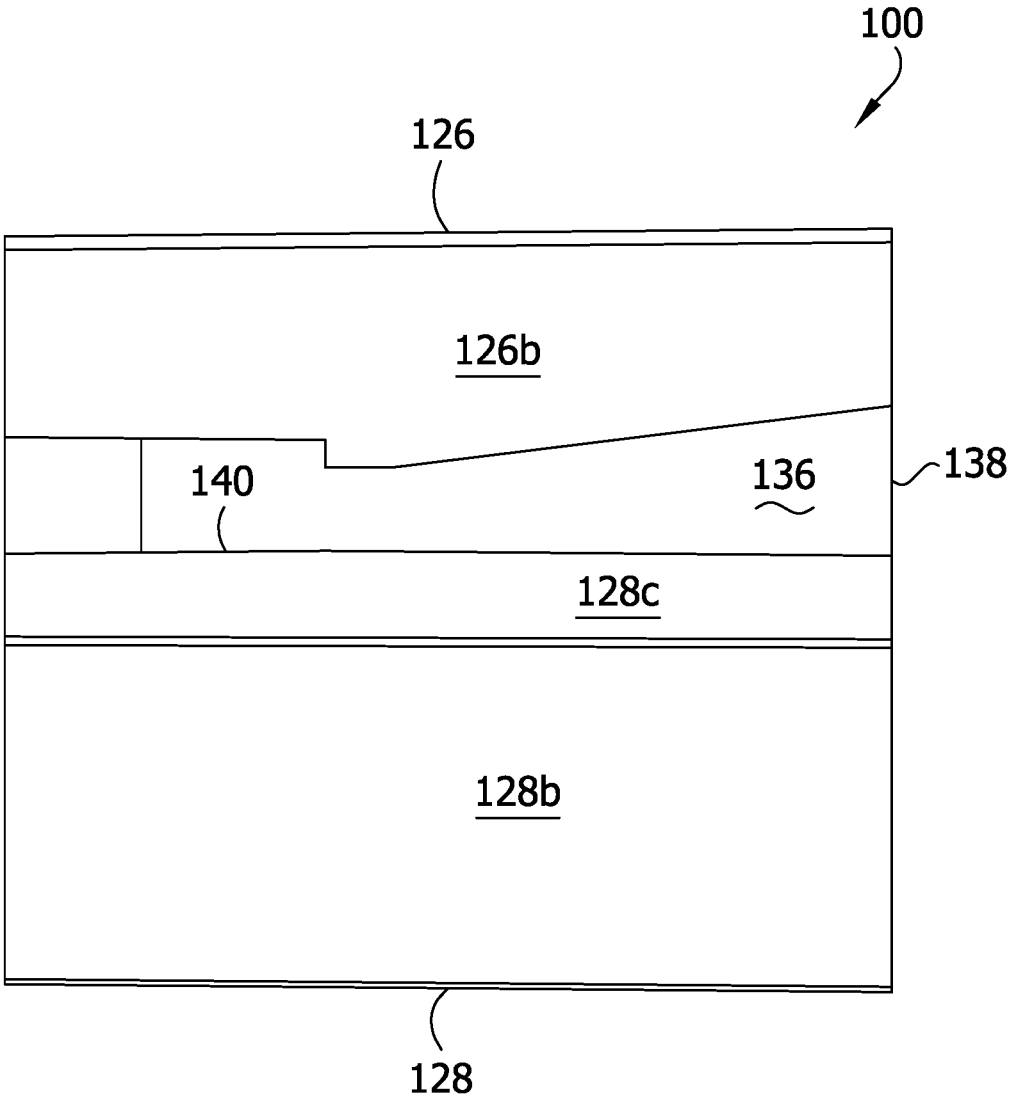
FIG. 12 is a bottom plan of the tamper-evident attachment of FIG. 9.

As can be seen from FIGS. 6 and 7, the ratchet head 14 is slidably receivable into the cavity 36 of the tamper-evident attachment 10 through front opening 38, and a portion of the strap 18 adjacent the ratchet head extends downward through the bottom opening 40. The walls 26, 28, 30, and 32 align the portion of the head opening 17 the strap 18 extends through with the slot-shaped openings 44, 46 in the left and right walls. In the illustrated embodiment, the walls 26, 28, 32 are slightly tapered inward (e.g., toward one another) as they extend from the front opening 38 to the rear wall 30 so that the left, right and upper walls engage the ratchet head 14 when the ratchet head is received in the cavity 36 to align the head opening 17 with the slot-shaped openings 44, 46. In addition, the engagement of tapered walls 26, 28, 32 with the ratchet head 14 forms a friction fit to help hold the tamper-evident attachment 10 on the cable tie 12. As shown in FIG. 8, with the slot-shaped openings 44, 46 aligned, the free end of the strap 18 can be inserted through the slot-shaped opening 44 in the left wall 26, through the head opening 17 in the ratchet head 14, and through the slot-shaped opening 46 in the right wall 28. In this way, the assembled cable tie 12 and attachment 10 can function as a security seal for a ballot box B, as shown in FIG. 8. As can be understood, the attachment 10 is fixedly secured to the ratchet head 14 of the cable tie 12 when the cable tie is secured to the ballot box B. Moreover, any gap between the strap 18 and the slot-shaped openings 44, 46 is too small for a tool to be inserted therebetween to gain access to the deflectable pawl 16 of the ratchet head 14. Thus, the attachment 10 is configured as a cap (broadly, a ratchet head cover) for the ratchet head 14 that covers the head opening 17 and the pawl 16 to inhibit access to the pawl. In order to release the cable tie 12 by deflecting the pawl 16 with a tool, the attachment 10 would need to be removed, such as by cutting or breaking the attachment, or otherwise physically damaged or deformed—thereby indicating tampering. Therefore, by attaching the tamper-evident attachment 10 to the cable tie 12, a security seal is formed that can indicate tampering. The attachment 10 and/or cable tie 12 may include indicia, such as a serial number or some other unique identifier.

Referring to FIGS. 9-15, another embodiment of a tamper-evident attachment for a cable tie is generally indicated at reference numeral 100. Tamper-evident attachment 100 is analogous to tamper-evident attachment 10 and, thus, for ease of comprehension, where analogous parts are used, reference numerals "100" units higher are employed. Tamper-evident attachment 100 is generally the same as tamper-evident attachment 10 except that the tamper-evident attachment 100 includes a detent 126*c* (e.g., catch) configured to engage and hold the tamper-evident attachment 100 on the cable tie 12. In this embodiment, the left wall 126 of the tamper-evident attachment 100 includes an upper planar portion 126*a* and a lower flange portion 126*b* projecting outward from a lower end of the upper planar portion toward the right wall 128 (more specifically, the lower flange portion 128*c*). The lower flange portion 126*b* of the left wall 126 includes the detent 126*c* configured to engage a portion of the strap 18 of the cable tie 12 adjacent the ratchet head 14 to hold the tamper-evident attachment 100 on the cable tie. The detent 126*c* extends into the bottom opening 140.

Figure 13:
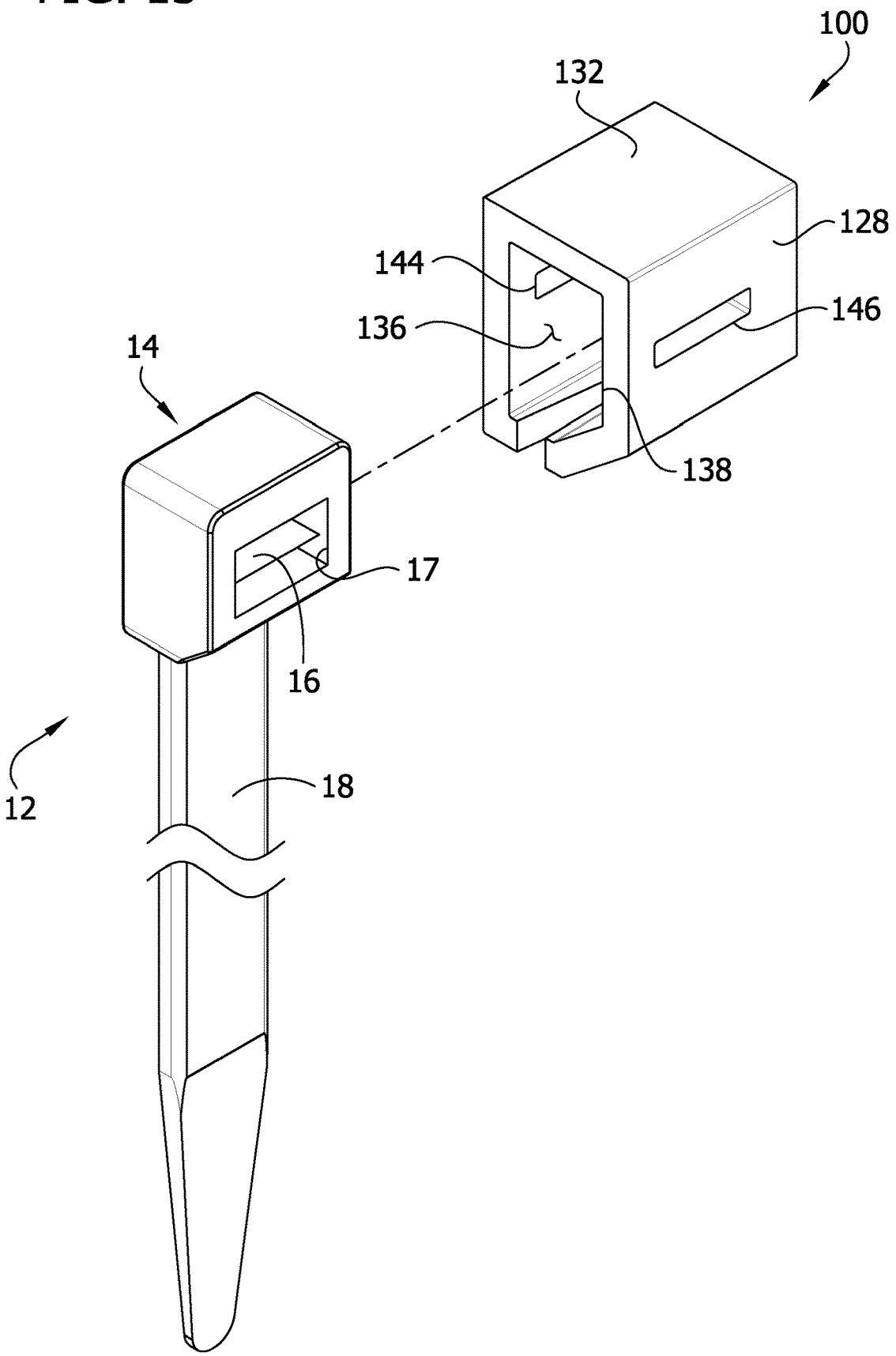
FIG. 13 is a perspective illustrating the tamper-evident attachment of FIG. 9 being coupled to the cable tie.
Figure 14:
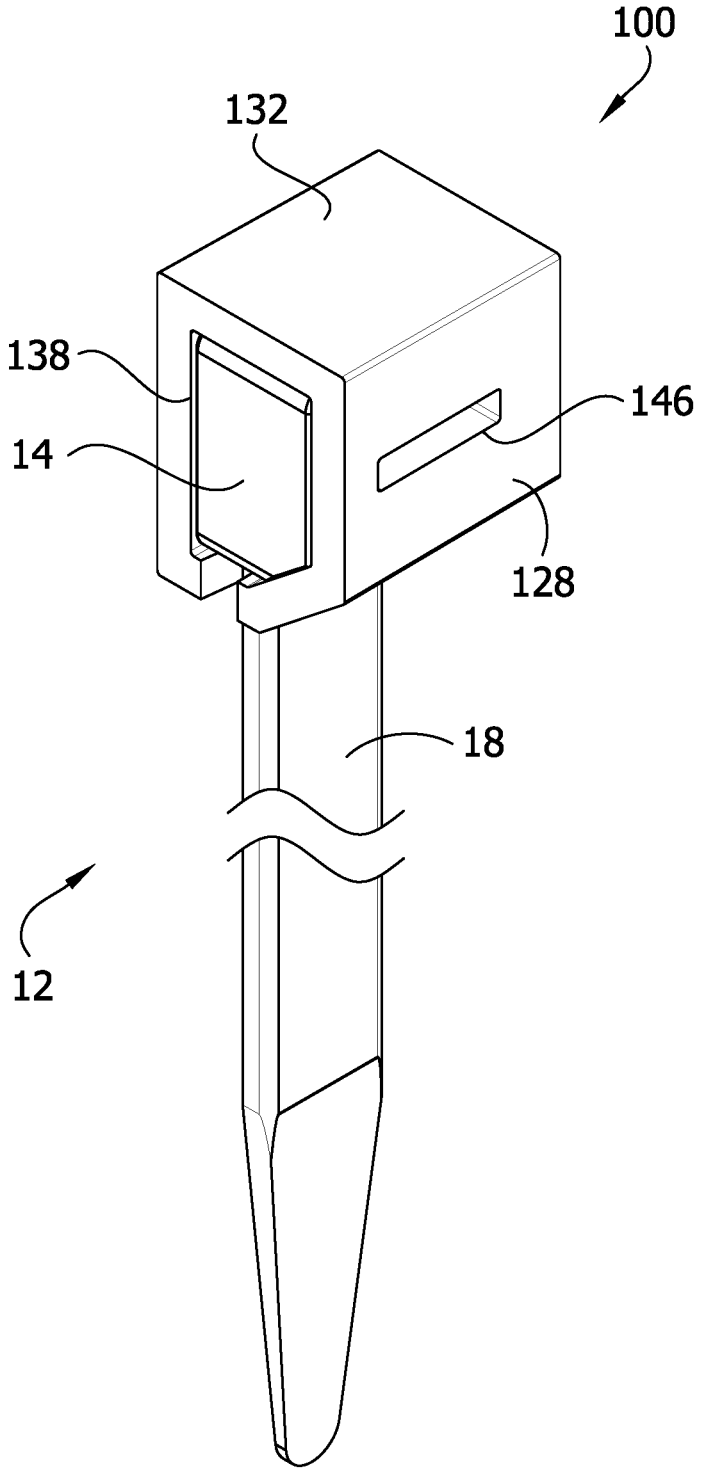
FIG. 14 is a front perspective of the tamper-evident attachment of FIG. 9 coupled to the cable tie to form a tamper-evident security seal.
Figure 15:
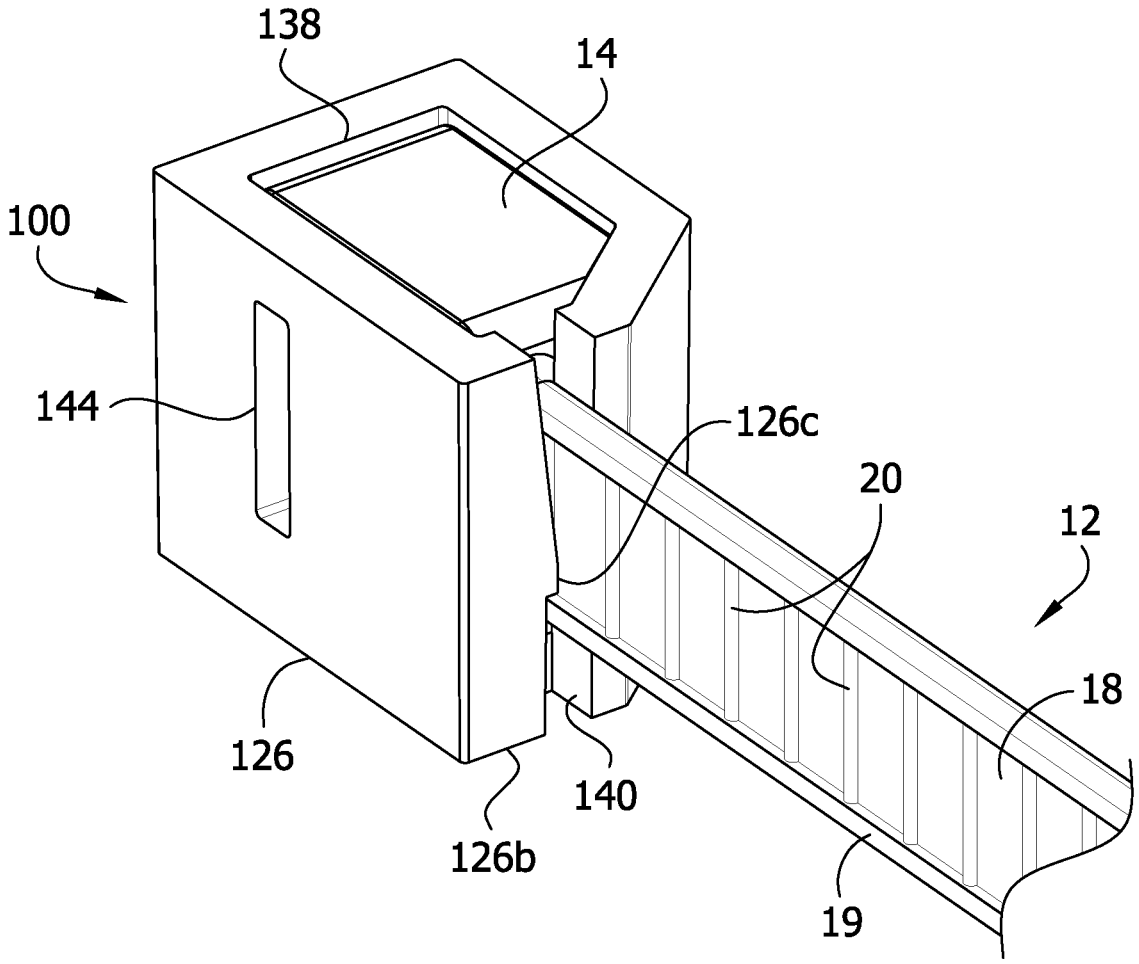
FIG. 15 is a bottom perspective thereof.

As can be seen from FIGS. 13-15, the ratchet head 14 is slidably receivable into the cavity 136 of the tamper-evident attachment 100 through front opening 138, and a portion of the strap 18 adjacent the ratchet head extends downward through the bottom opening 140. In this embodiment, the detent 126*c* engages a portion of the strap 18, such as a side rib 19, that extends through the bottom opening 140 to more firmly hold the tamper-evident attachment 100 on the ratchet head 14 (FIG. 15) until the strap is inserted through the attachment, as described above.

Modifications and variations of the disclosed embodiments are possible without departing from the scope of the invention defined in the appended claims. For example, where specific dimensions are given, it will be understood that they are exemplary only and other dimensions are possible.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A tamper-evident attachment for a cable tie of the type including a ratchet head defining a head opening and having a deflectable pawl in the head opening, and a flexible strap extending from the ratchet head, the tamper-evident attachment comprising:

a ratchet head cover configured to couple to the ratchet head of the cable tie such that the ratchet head cover covers at least a portion of the head opening to inhibit access to the pawl, the ratchet head cover defining at least one slot-shaped opening positioned to align with the head opening of the ratchet head when the ratchet head cover is coupled to the ratchet head, the at least one slot-shaped opening being sized and shaped to receive the strap of the cable tie therethrough, wherein the ratchet head cover further includes a left wall, a right wall generally opposing the left wall, a rear wall extending between and connecting the left and right walls, and an upper wall interconnecting upper ends of the left wall, right wall, and rear wall.

2. The tamper-evident attachment of claim 1, wherein the at least one slot-shaped opening includes two slot-shaped openings positioned to align on either side of the head opening of the ratchet head such that the strap can extend through the two slot-shaped openings and the head opening when the ratchet head cover is coupled to the ratchet head.

3. The tamper-evident attachment of claim 1, wherein the at least one slot-shaped opening is sized and shaped to be in a close fitting relationship with the strap of the cable tie when the strap is received in the at least one slot-shaped opening to inhibit access to the pawl of the cable tie.

4. The tamper-evident attachment of claim 1, wherein the left, right, rear, and upper walls ratchet head cover define a cavity configured to receive the ratchet head of the cable tie.

5. The tamper-evident attachment of claim 4, wherein the ratchet head cover further defines a front opening in communication with the cavity, the front opening sized and shaped to allow the ratchet head of the cable tie to be inserted therethrough to be positioned in the cavity.

6. The tamper-evident attachment of claim 5, wherein the ratchet head cover further defines a bottom opening in communication with the cavity and the front opening, the bottom opening sized and shaped to receive the strap of the cable tie therethrough when the ratchet head cover is coupled to the ratchet head.

7. The tamper-evident attachment of claim 1, wherein the ratchet head cover further includes a detent configured to engage the cable tie to hold the ratchet head cover on the ratchet head of the cable tie when the ratchet head cover is coupled to the ratchet head.

8. The tamper-evident attachment of claim 7, wherein the detent engages the strap of the cable tie to hold the ratchet head cover on the ratchet head.

9. The tamper evident attachment of claim 1, wherein the left wall, right wall, rear wall, and upper wall each have an interior surface, the interior surfaces defining a cavity sized and shaped to receive the ratchet head of the cable tie.

10. The tamper-evident attachment of claim 1, wherein at least one of the right and left walls defines the at least one slot-shaped opening.

11. A tamper-evident security seal comprising:

a cable tie including a ratchet head defining a head opening and including a deflectable pawl in the head opening, and a flexible strap extending from the ratchet head; and a tamper-evident attachment coupled to the ratchet head of the cable tie and covering at least a portion of the head opening to inhibit access to the pawl, the tamper-evident attachment defining at least one slot-shaped opening aligned with the head opening of the ratchet head that is sized and shaped to receive the strap of the cable tie therethrough, wherein the tamper-evident attachment includes a detent engaging the cable tie and holding the tamper evident attachment on the ratchet head of the cable tie before the strap of the cable tie is received through the at least one slot-shaped opening and the head opening of the ratchet head.

12. The tamper-evident security seal of claim 11, wherein the at least one slot-shaped opening includes two slot-shaped openings positioned to align on either side of the head opening of the ratchet head such that the strap can extend through the two slot-shaped openings and the head opening when the tamper-evident attachment is coupled to the ratchet head.

13. The tamper-evident security seal of claim 11, wherein the tamper-evident attachment further defines a cavity, the ratchet head of the cable tie being positioned in the cavity.

14. The tamper-evident security seal of claim 11, wherein the tamper-evident attachment is integrally formed with the ratchet head of the cable tie.

15. A tamper-evident attachment for a cable tie of the type including a ratchet head defining a head opening and having a deflectable pawl in the head opening, and a flexible strap extending from the ratchet head, the tamper-evident attachment comprising:

a ratchet head cover configured to couple to the ratchet head of the cable tie such that the ratchet head cover covers at least a portion of the head opening to inhibit access to the pawl, the ratchet head cover defining at least one slot-shaped opening positioned to align with the head opening of the ratchet head when the ratchet head cover is coupled to the ratchet head, the at least one slot-shaped opening being sized and shaped to receive the strap of the cable tie therethrough, wherein the ratchet head cover includes a detent configured to engage the cable tie to hold the ratchet head cover on the ratchet head of the cable tie before the strap of the cable tie is received through the at least one slot-shaped opening and the head opening of the ratchet head.

16. The tamper-evident attachment of claim 15, wherein the at least one slot-shaped opening includes two slot-shaped openings positioned to align on either side of the head opening of the ratchet head such that the strap can extend through the two slot-shaped openings and the head opening when the ratchet head cover is coupled to the ratchet head.

17. The tamper-evident attachment of claim 15, wherein the at least one slot-shaped opening is sized and shaped to be in a close fitting relationship with the strap of the cable tie when the strap is received in the at least one slot-shaped opening to inhibit access to the pawl of the cable tie.

18. The tamper-evident attachment of claim 15, wherein the ratchet head cover further defines a cavity configured to receive the ratchet head of the cable tie.

* * * * *